US009377731B1

(12) United States Patent
Watanabe et al.

(10) Patent No.: US 9,377,731 B1
(45) Date of Patent: Jun. 28, 2016

(54) IMAGE FORMING APPARATUS

(71) Applicant: Konica Minolta, Inc., Chiyoda-ku, Tokyo (JP)

(72) Inventors: Masayuki Watanabe, Fuchu (JP); Hiroshi Yamaguchi, Toyokawa (JP); Hitoshi Asano, Toyokawa (JP); Daichi Suzuki, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/972,973

(22) Filed: Dec. 17, 2015

(30) Foreign Application Priority Data

Dec. 19, 2014 (JP) ..... 2014-257758

(51) Int. Cl.
*G03G 15/20* (2006.01)

(52) U.S. Cl.
CPC ..... *G03G 15/205* (2013.01)

(58) Field of Classification Search
CPC ..... G03G 15/205
USPC ..... 399/69, 70
See application file for complete search history.

(56) References Cited

U.S. PATENT DOCUMENTS 5,854,959 A * 12/1998 Mirabella, Jr. ..... G03G 15/2003 219/216
6,810,220 B2 * 10/2004 Hamada ..... G03G 15/205 219/216
9,031,439 B2 * 5/2015 Hase ..... G03G 15/205 399/69
2016/0018769 A1 * 1/2016 Wagatsuma ..... G03G 15/2039 399/69

FOREIGN PATENT DOCUMENTS

JP 2008-203685 A 9/2008

* cited by examiner

*Primary Examiner* — Susan Lee
(74) *Attorney, Agent, or Firm* — Buchanan Ingersoll & Rooney PC

(57) ABSTRACT

An image forming apparatus includes: a fixing unit configured to include at least a first and second radiation heaters capable of heating printing medium; a power supply unit configured to supply power to the first and second radiation heaters; and a controller configured to select either one of the first and second radiation heaters and control to light or turn off the selected radiation heater, wherein a heating width of the printing medium of the second radiation heater is wider than that of the first radiation heater, and the controller determines whether to preheat the second radiation heater based on the number of times of lighting of the first and second radiation heaters and controls to light and turn off the second radiation heater when the controller has determined that it is necessary to preheat the second radiation heater.

9 Claims, 7 Drawing Sheets

IMAGE FORMING APPARATUS

The entire disclosure of Japanese Patent Application No. 2014-257758 filed on Dec. 19, 2014 including description, claims, drawings, and abstract are incorporated herein by reference in its entirety.

BACKGROUND OF THE INVENTION

1. Field of the Invention

The present invention relates to an image forming apparatus which fixes toner on printing medium by a fixing unit including a first and second radiation heaters which have heating widths different from each other.

2. Description of the Related Art

Conventionally, there has been an image forming apparatus disclosed in JP 2008-203685 A as the above-mentioned image forming apparatus. In JP 2008-203685 A, a heating roller of a fixing unit includes a short heater and a long heater as a first and second radiation heaters. Here, a heating width of the printing medium of the long heater is wider than that of the short heater. The temperature of the fixing unit is controlled so that lighting times of both heaters or use times of them converge on the same value.

In recent years, on/off control of the radiation heater has been performed so that a temperature fluctuation range of the heating roller of the fixing unit is reduced in order to improve image quality. The on/off control to the radiation heater included in the fixing unit has been performed in a short period in many cases. It has been considered so far that an inrush current of the radiation heater has had a small influence on a life of the radiation heater. Under a use condition where on/off control in the short period is often performed, the influence cannot be ignored.

At the time of warm-up or standby, it is necessary to heat a full width of the heating roller, and the long heater having a wide heating width is used. Therefore, the long heater is used at high frequency. Accordingly, when the on/off control is simply performed to the long heater, the number of the damages to the long heater due to an inrush current increases, and the life of the long heater ends earlier.

In many cases, the fixing unit is exchanged by a unit of the fixing unit not the radiation heater. Therefore, even though the short heater has enough time before the end of its life, there is a case where a user needs to exchange the fixing unit due to the end of the life of the long heater. In this way, it is not desirable that times to end the life of both radiation heaters are largely different from each other.

SUMMARY OF THE INVENTION

An object of the present invention is to provide an image forming apparatus which can reduce the time difference between time to end the short heater and that of the long heater which have different heating widths from each other.

To achieve the abovementioned object, according to an aspect, an image forming apparatus reflecting one aspect of the present invention comprises: a fixing unit configured to include at least a first and second radiation heaters capable of heating printing medium; a power supply unit configured to supply power to the first and second radiation heaters; and a controller configured to select either one of the first and second radiation heaters and control to light or turn off the selected radiation heater so that a temperature of the fixing unit becomes a target value, wherein a heating width of the printing medium of the second radiation heater is wider than that of the first radiation heater, and the controller determines whether to preheat the second radiation heater based on the number of times of lighting of the first and second radiation heaters before a predetermined operation mode and controls to light and turn off the second radiation heater after lighting the first radiation heater when the controller has determined that it is necessary to preheat the second heater.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 3 is a flowchart of a processing procedure of a controller in FIG. 2 at the time of warm-up and the like;

DESCRIPTION OF THE PREFERRED EMBODIMENTS

Hereinafter, an embodiment of the present invention will be described with reference to the drawings. However, the scope of the invention is not limited to the illustrated examples.

First Column: Whole Structure and Printing Operation of Image Forming Apparatus

Figure 1:
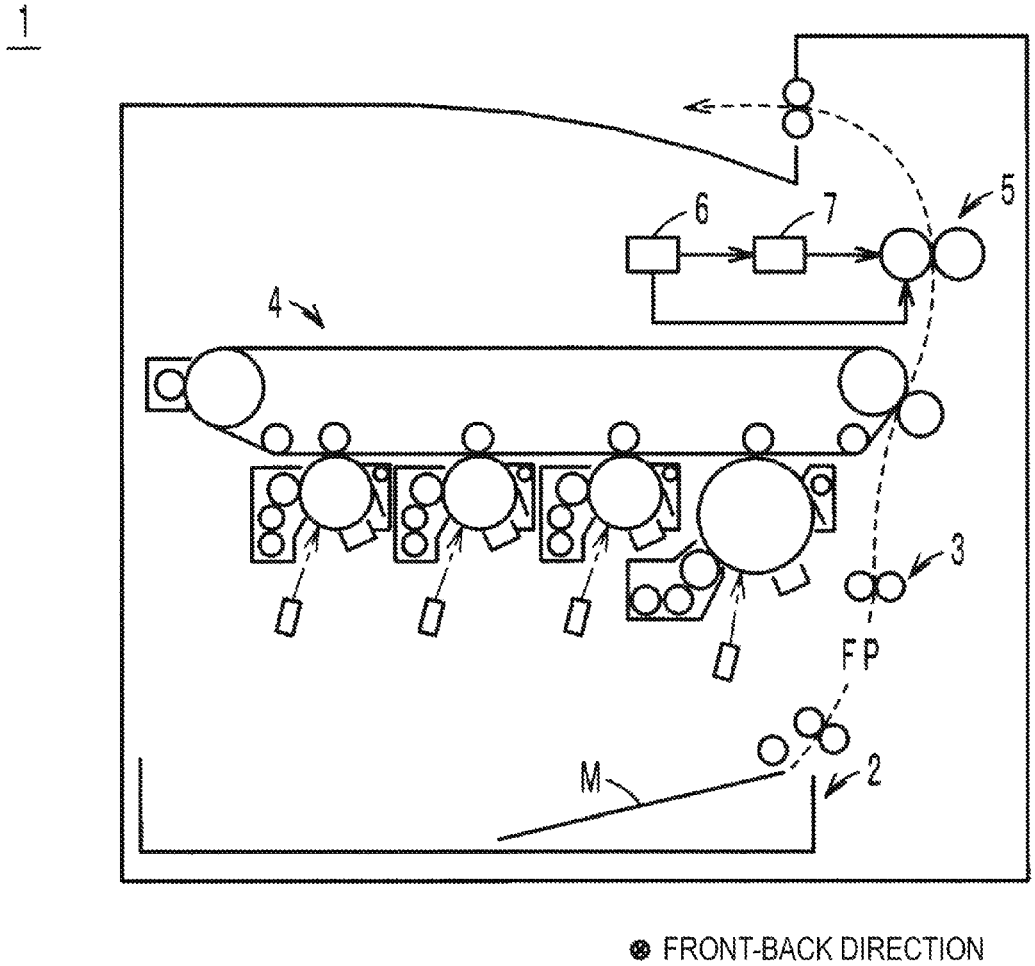
FIG. 1 is a schematic diagram of an inside of an image forming apparatus viewed from the front side.

In FIG. 1, for example, an image forming apparatus 1 is a copying machine, a printer, a facsimile, or a multifunction machine including these functions. The image forming apparatus 1 prints an image on a sheet-shaped printing medium M (for example, paper sheet). To achieve the above, the image forming apparatus 1 generally includes a paper feeding unit 2, a pair of register rollers 3, an image forming unit 4, a fixing unit 5, a controller 6, and a power supply unit 7.

The printing medium M is mounted on the paper feeding unit 2. The paper feeding unit 2 feeds the printing medium M one by one to a conveyance path FP indicated by a broken line in FIG. 1. The pair of register rollers 3 is provided on the conveyance path FP and provided on the downstream side of the paper feeding unit 2. After temporarily stopping the printing medium M fed from the paper feeding unit 2, the pair of register rollers 3 feeds the printing medium M to a secondary transfer region at a predetermined timing.

The image forming unit 4 generates a toner image on an intermediate transfer belt, for example, by using a known electrophotographic method and tandem system. The toner image is held on the intermediate transfer belt and is conveyed to the secondary transfer region.

The printing medium M is fed from the pair of register rollers 3 to the secondary transfer region, and also, the toner image is conveyed from the image forming unit 4 to the secondary transfer region. In the secondary transfer region, the toner image is transferred from the intermediate transfer belt on the printing medium M.

The printing medium M fed from the secondary transfer region is introduced into the fixing unit 5. The fixing unit 5 fixes the toner on the printing medium M by heating and pressurizing the introduced printing medium M. The printing medium M fed from the fixing unit 5 is discharged on a tray of the image forming apparatus 1 as a printed matter.

In the controller 6, a CPU executes a program stored in a ROM while using a RAM as a working area. The controller 6 performs various controls. However, energization control to the fixing unit 5 is important in the present embodiment. Specifically, the controller 6 performs the control so that the detection result by a temperature detection unit 55 (refer to FIG. 2) becomes the target temperature.

Figure 2:
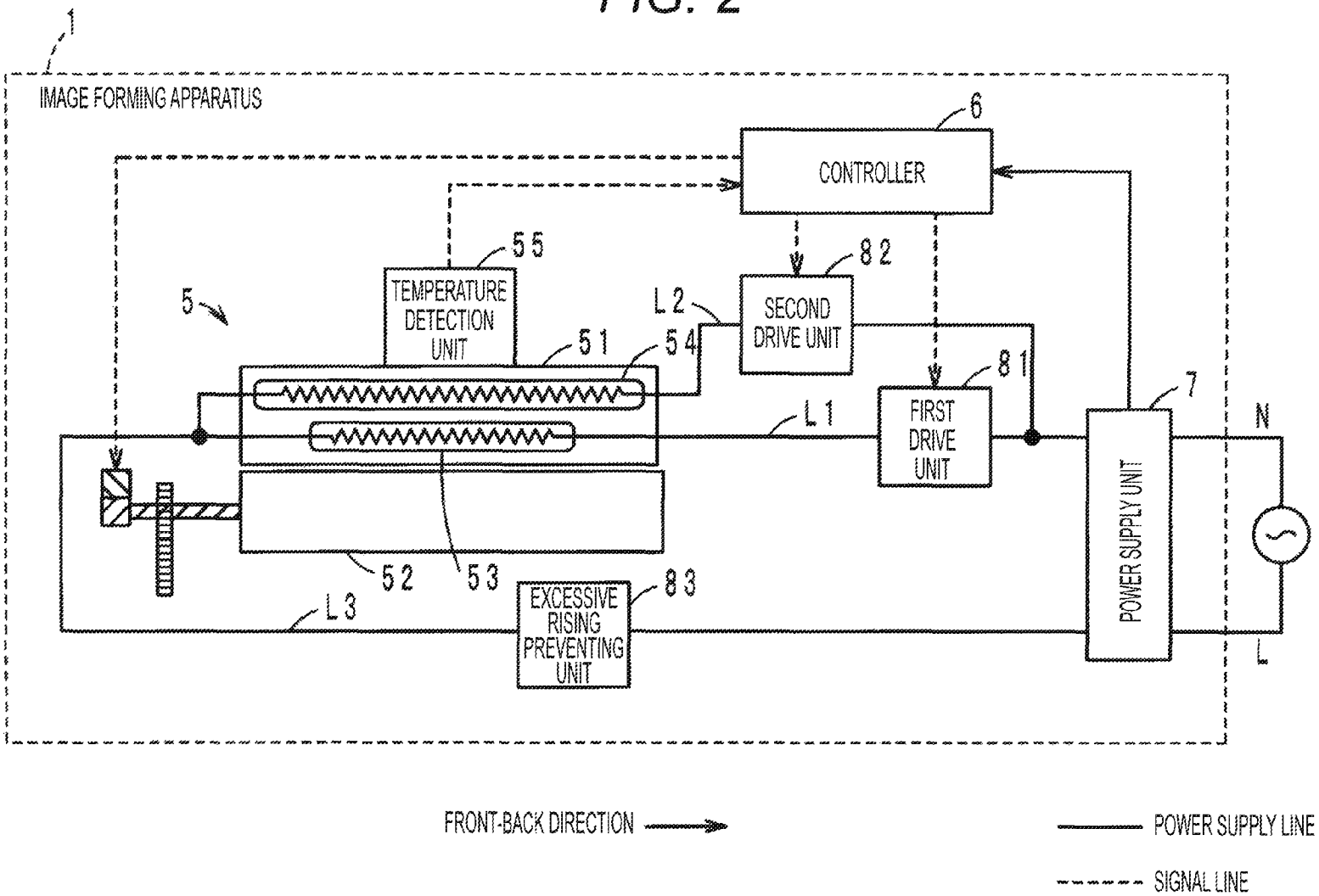
FIG. 2 is a schematic diagram of a main part of the image forming apparatus.

Second column: Detailed structure of main part of image forming apparatusNext, the main part of the present embodiment, that is, the fixing unit 5, the controller 6, and the power supply unit 7 will be described. As illustrated in FIG. 2, the fixing unit 5 includes a heating roller 51 and a pressure roller 52 which abut on each other and form a nip. The heating roller 51 and the pressure roller 52 extend in the front-back direction.

For example, the heating roller 51 includes a cylindrical core bar extending in the front-back direction of the image forming apparatus 1. For example, the thickness of the core bar is thinned to about one mm, and the outer diameter of the core bar is reduced to about 25 mm. Accordingly, a heat capacity of the heating roller 51 is reduced.

Further, in the heating roller 51, a first radiation heater 53 and a second radiation heater 54 are included in the core bar. Both heaters 53 and 54 are optical heating system heaters such as a halogen heater. When an output voltage from the power supply unit 7 is applied to each of the heaters 53 and 54, a current flows into a filament, and the filament is heated and lighted. For example, the filament is formed of tungsten. Here, as is well known, the resistivity of tungsten increases as the temperature gets higher. In other words, both heaters 53 and 54 have resistance temperature characteristic such that a resistance value increases as the temperature gets higher.

Further, the first radiation heater 53 is shorter than the second radiation heater 54 in the front-back direction. Specifically, the first radiation heater 53 has a light emission length (for example, about 210 mm) which is relatively short in the front-back direction. Whereas, the second radiation heater 54 has a light emission length (for example, about 310 mm) which is longer than the first radiation heater 53 in the front-back direction. By providing both the heaters 53 and 54 in the heating roller 51, two kinds of heating widths which is relatively different from each other in the front-back direction are realized.

Further, the second radiation heater 54 has a power consumption (for example, equal to or larger than 1000 W) larger than that of the first radiation heater 53, for example, in order to shorten the warm-up time. Conversely, the first radiation heater 53 has a power consumption (for example, equal to or smaller than 800 W) smaller than that of the second radiation heater 54. Drive units 81 and 82 respectively perform control and switch on/off of the heaters 53 and 54. However, since the second radiation heater 54 has large power consumption, the second radiation heater 54 receives larger influence of the inrush current than the first radiation heater 53.

The pressure roller 52 and the heating roller 51 rotate based on a control signal from the controller 6. When the printing medium M is fed to the nip, the printing medium M is pressurized by both the rollers 51 and 52 and also heated by the heating roller 51. As a result, the toner is fixed on the printing medium M.

The temperature detection unit 55 is included near the heating roller 51. For example, the temperature detection unit 55 is a thermistor. The temperature detection unit 55 outputs a signal correlating with the temperature of the heating roller 51 (as a matter of convenience, simply refer to as temperature below) to the controller 6.

The power supply unit 7 rectifies all alternating currents supplied from a commercial power supply and performs DC conversion to it and generates a plurality of DC voltages based on the converted current. Then, the power supply unit 7 supplies them to the controller 6 and a drive unit which is not shown. On the other hand, power supply lines L (live) and N (neutral) of the power supply unit 7 are used to light the first radiation heater 53 and the second radiation heater 54. The power supply line L is connected to an end of each of the heaters 53 and 54 via an excessive rising preventing unit 83, for example, configured of a thermostat. The excessive rising preventing unit 83 has a function to cut off power supply from the power supply unit 7 when the fixing unit 5 is abnormally overheated.

The first drive unit 81 and the second drive unit 82 are respectively provided on another sides L1 and L2 of the respective heaters 53 and 54, and the lines L1 and L2 are connected to the power supply line N. Both the drive units 81 and 82 include switching units such as a solid state relay (SSR), and the drive units are turned on/off under the control of the controller 6. According to this, application voltages to the heaters 53 and 54 are turned on/off.

Figure 3:
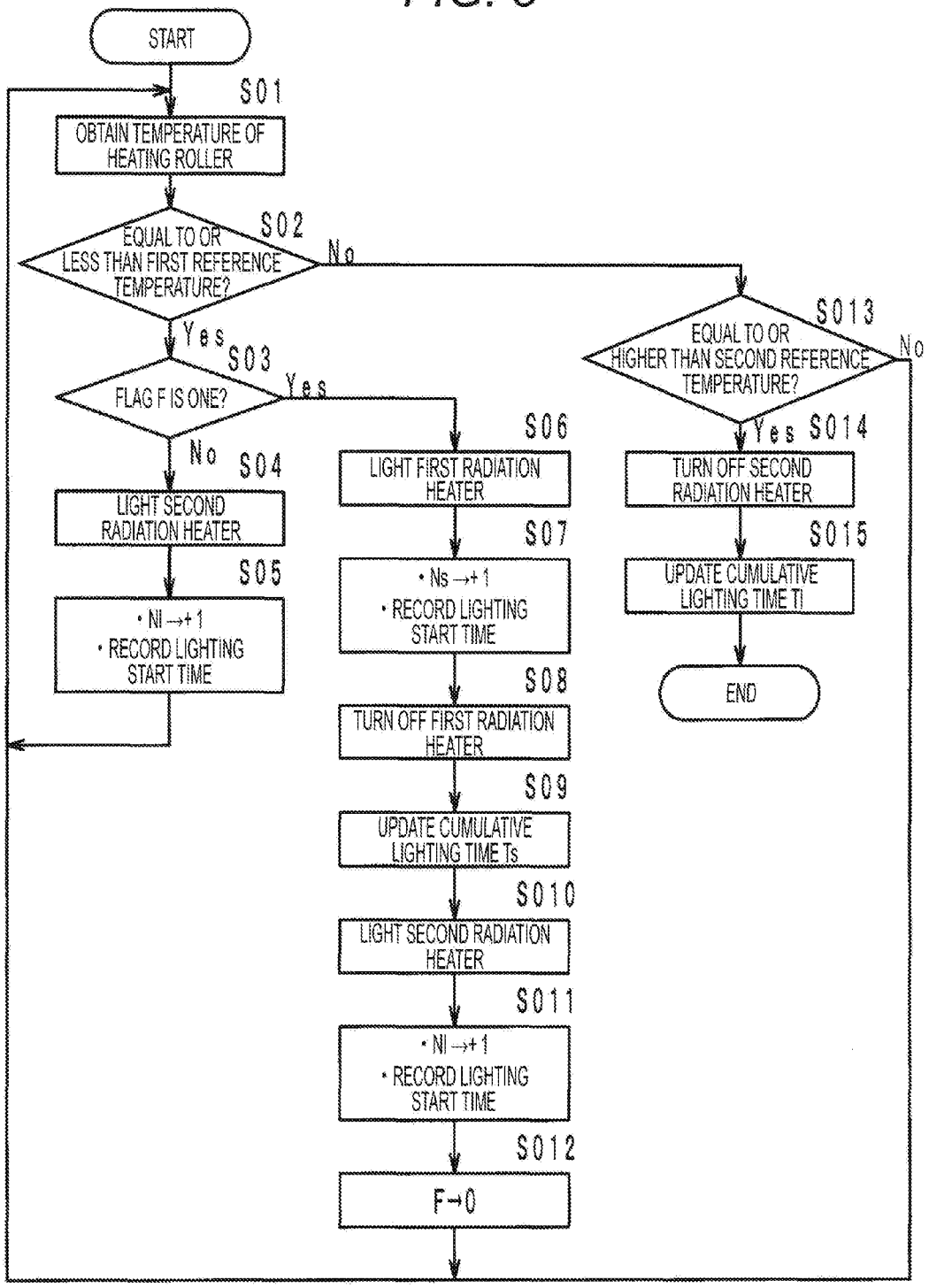

Third column: Fixing temperature control at the time of warm-up or standby The controller 6 performs processing of fixing temperature control in FIG. 3 when an operation mode of the image forming apparatus 1 is one of the time of warm-up or the time of standby. In FIG. 3, first, the controller 6 receives a temperature of the heating roller 51 from the temperature detection unit 55 and determines whether the received temperature is equal to or lower than a predetermined first reference temperature (S01 and S02). The first reference temperature is a lower limit value in a target temperature range of the heating roller during warm-up or standby and is appropriately and adequately determined.

When it has been determined as Yes in S02, the controller 6 determines whether a flag F which has been set in a non-volatile memory and the like in the controller 6 is set to be one (S03). The flag F will be described in detail below.

When it has been determined as No in S03, the controller 6 considers that a preheating control execution condition is not satisfied and lights the second radiation heater 54 (S04). At this time, the controller 6 turns on the second drive unit 82. As a result, the output voltage of the power supply unit 7 is applied to the second radiation heater 54, and the current flows. This lights the second radiation heater 54.

Next, the controller 6 increments a second counter provided in the non-volatile memory and the like by one in S05. The second counter counts the number of times of lighting Nl of the second radiation heater 54. In addition, the controller 6 records lighting start time of the second radiation heater 54 in a storage area provided in the non-volatile memory and the like (S05). After that, the controller 6 performs the processing in S01 again.

Further, when it has been determined as Yes in S03, the controller 6 considers that the preheating control execution condition is satisfied and lights the first radiation heater 53 (S06). The first radiation heater 53 is lighted in S06 in order to preheat the second radiation heater 54. In other words, the temperature of the heating roller 51 is not controlled. Therefore, the controller 6 may continuously light the first radiation heater 53 in a period of the preheating control.

Next, the controller 6 increments a first counter provided in the non-volatile memory and the like by one in S07. The first counter counts the number of times of lighting Ns of the first radiation heater 53. In addition, the controller 6 records the lighting start time of the first radiation heater 53 in the storage area provided in the non-volatile memory and the like (S07).

Next, the controller 6 turns off the first radiation heater 53 after a predetermined time elapses (S08). After that, the controller 6 adds the lighting time from the lighting start time to turn-off time recorded in S07 to a current value of a third counter provided in the non-volatile memory and the like in order to count cumulative lighting time Ts of the first radiation heater 53 (S09).

Next, the controller 6 lights the second radiation heater 54 by using a method similar to that in S04 (S010). Next, similarly to S05, the controller 6 increments the second counter by one and records the lighting start time of the second radiation heater 54 (S011). After that, the controller 6 clears the flag F (in other words, set the flag F to zero) (S012) and performs the processing in S01 again.

Further, when it has been determined as No in S02, the controller 6 determines whether the temperature received in S01 is equal to or higher than a second reference temperature (S013). The second reference temperature is an upper limit value of the target temperature range for warm-up and the like and is set to a value larger than the first reference temperature.

When it has been determined as Yes in S013, the controller 6 turns off the second radiation heater 54 (S014). After that, the controller 6 adds the lighting time from the lighting start time to the turn-off time recorded in S05 to a current value of a fourth counter provided in the non-volatile memory and the like in order to count the cumulative lighting time Tl of the second radiation heater 54 (S015). After that, the controller 6 terminates the processing in FIG. 3. Further, when it has been determined as No in S013, the controller 6 performs the processing in S01 again.

Fourth Column: Effect of Fixing Temperature Control at the Time of Warm-Up or Standby According to the fixing temperature control described in the third column, when the flag F to be described below is one, the second radiation heater 54 is preheated by lighting the first radiation heater 53 before being lighted. Due to the preheating, the resistance value of tungsten in the second radiation heater 54 increases, and after that, the output voltage of the power supply unit 7 is applied. Therefore, the inrush current which flows in the second radiation heater 54 is smaller than that of a case of no preheating. As a result, the damage to the second radiation heater 54 can be reduced, and the life of the second radiation heater 54 can be prolonged.

Fifth Column: Setting Value of Flag F

Figure 4:
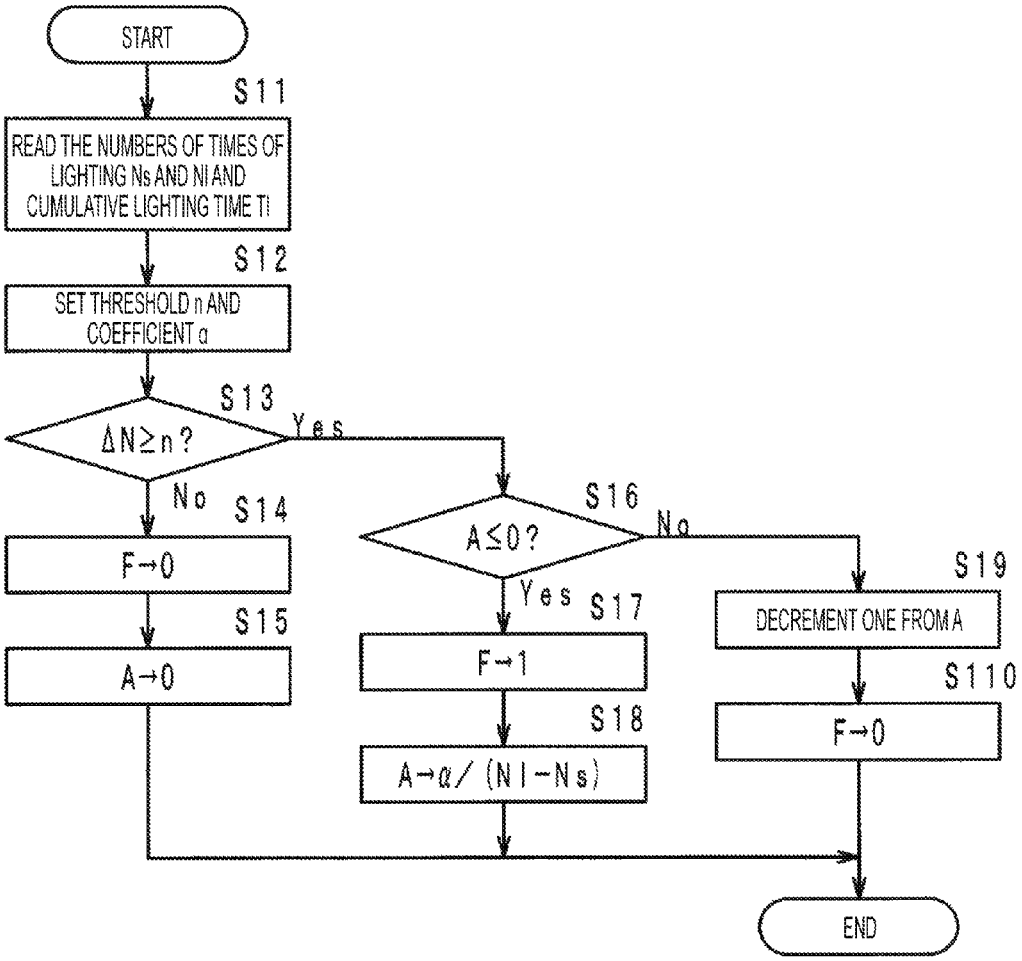
FIG. 4 is a flowchart of a processing procedure of the controller in FIG. 2 at the time of setting a flag.

The controller 6 performs the processing in FIG. 4 at every timing defined by a main flow (not shown) of the image forming apparatus 1. In FIG. 4, the controller 6 reads the number of times of lighting Ns of the first radiation heater 53 and the cumulative lighting time Tl and the number of times of lighting N1 of the second radiation heater 54 from the non-volatile memory in the controller (S11).

Next, the controller 6 sets a threshold n and a coefficient α for preheating determination based on the cumulative lighting time Tl read in S11 (S12). Here, the threshold n and the coefficient α are variable values and defined by a program and the like so as to be smaller as the cumulative lighting time Tl gets longer. By defining the threshold n and the coefficient α in this way, when the second radiation heater 54 has been used for a long time, it is easy to perform the preheating control. Therefore, this is preferable to solve the problem set herein. It is preferable that the specific values of the threshold n and the coefficient α be appropriately determined.

Next, the controller 6 obtains a value Nl-Ns as a difference in the numbers of times of lighting ΔN based on the numbers of times of lighting Ns and Nl read in S11. After that, the controller 6 determines whether ΔN≥n is satisfied (S13).

When it has been determined as No in S13, the controller 6 clears the flag F and an execution frequency A to be described (in other words, set the execution frequency A to zero) (S14 and S15).

Further, when it has been determined as Yes in S13, the controller 6 determines whether the execution frequency A to be described is equal to or less than zero (S16). The execution frequency A is a parameter which means that the second radiation heater 54 is once preheated by the first radiation heater 53 for every A times of lighting.

When it has been determined as Yes in S16, the controller 6 sets the flag F to be one, and after that, sets the execution frequency A to be a value obtained by using a following formula (1) (S17 and S18). After that, the controller 6 terminates the processing in FIG. 4.

$$A=\alpha/(Nl-Ns) \quad (1)$$

Whereas, when it has been determined as No in S16, the controller 6 decrements the execution frequency A by one and clears the flag F (S19 and S110). After S15, S18, and S110, the controller 6 terminates the processing in FIG. 4.

Sixth Column: Fixing Temperature Control at the Time of Printing

Figure 5A:
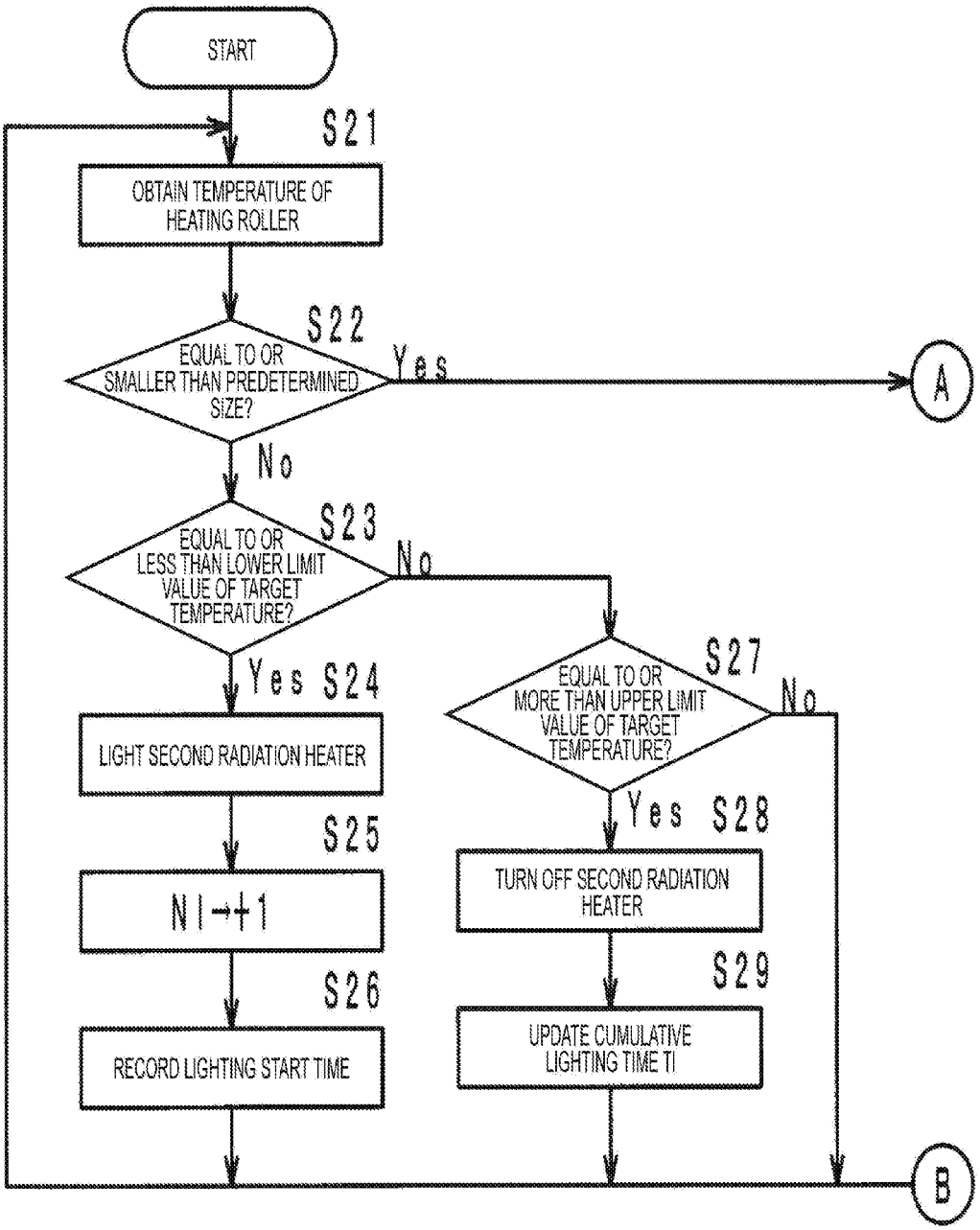
FIG. 5A is a flowchart of a part of a processing procedure of the controller in FIG. 2 at the time of printing.
Figure 5B:
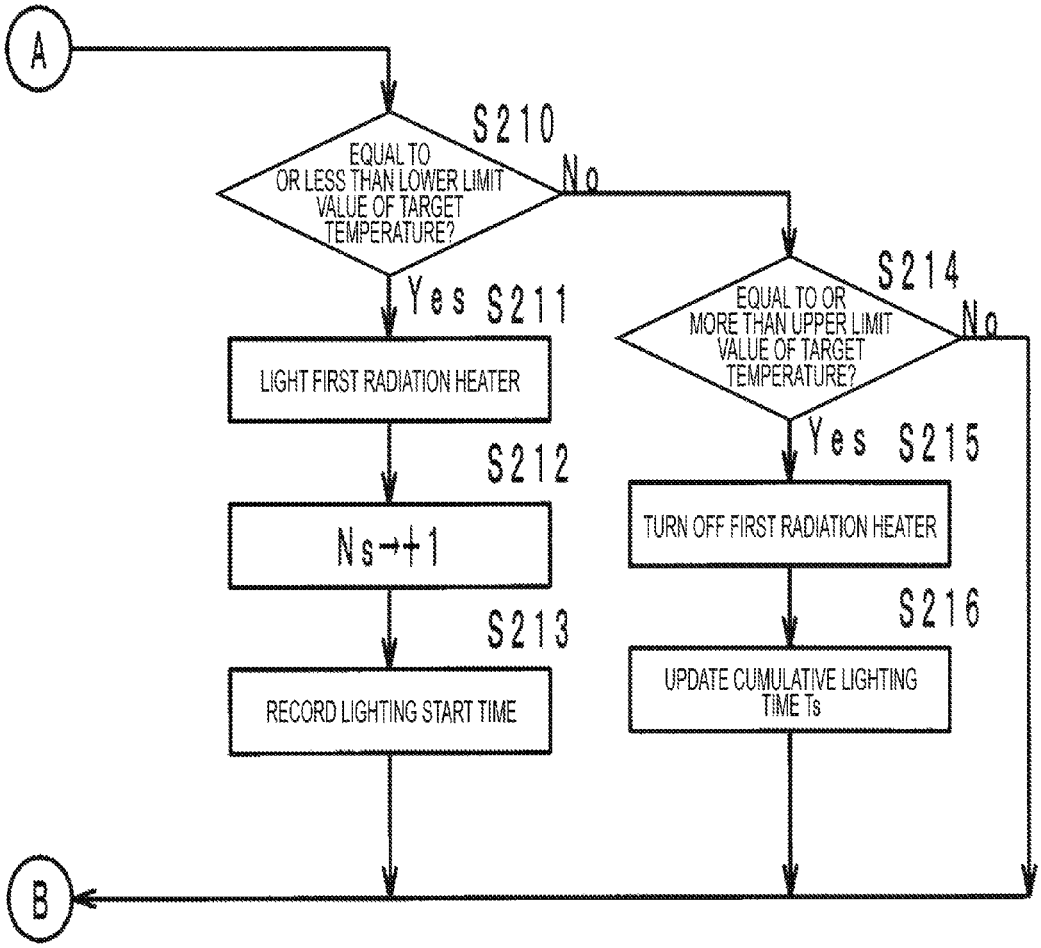
FIG. 5B is a flowchart of the rest of the processing procedure of the controller in FIG. 2 at the time of printing.

When the operation mode of the image forming apparatus 1 is to print, the controller 6 performs processing in FIGS. 5A and 5B. Here, since the fixing temperature control at the time of printing may be performed by using a known method, the description will be omitted. Processing regarding the cumulative lighting times Ts and Tl and the numbers of times of lighting Ns and Nl will be mainly described.

In FIG. 5A, first, the controller 6 receives the temperature of the heating roller 51 from the temperature detection unit 55 (S21). After that, the controller 6 determines whether a front-back direction width of the printing medium M to be used is equal to or shorter than a predetermined size (for example, short side length of A4 size) (S22).

When it has been determine as No in S22, the controller 6 determines whether the temperature received in S21 is equal to or lower than the lower limit value of the target temperature of the heating roller 51 (S23). When it has been determined as Yes in S23, the controller 6 lights the second radiation heater 54 (S24). After that, the controller 6 increments the second counter by one and records the lighting start time of the second radiation heater 54 (S25 and S26). After that, the controller 6 performs the processing in S21 again.

Whereas, when it has been determined as No in S23, the controller 6 determines whether the temperature received in S21 is equal to or higher than the upper limit value of the target temperature of the heating roller 51 (S27). When it has been determined as Yes in S27, the controller 6 turns off the second radiation heater 54 (S28). After that, the controller 6 adds the lighting time from the lighting start time to the turn-off time recorded in S24 to the current value of the fourth counter (S29). After S29 or when it has been determined as No in S27, the controller 6 performs the processing in S21 again.

When it has been determined as Yes in S22, the controller 6 determines whether the temperature received in S21 is equal to or lower than the lower limit value of the target temperature of the heating roller 51 (S210 in FIG. 5B). When it has been determined as Yes in S210, the controller 6 lights the first radiation heater 53 (S211). After that, the controller 6 increments the first counter by one and records the lighting start time of the first radiation heater 53 (S212 and S213). After that, the controller 6 performs the processing in S21 again.

Whereas, when it has been determined as No in S210, the controller 6 determines whether the temperature received in S21 is equal to or higher than the upper limit value of the target temperature of the heating roller 51 (S214). When it has been determined as Yes in S214, the controller 6 turns off the first radiation heater 53 (S215). After that, the controller 6 adds the lighting time from the lighting start time to the turn-off time recorded in S213 to the current value of the fourth counter (S216).

Seventh Column: Action and Effect of Image Forming Apparatus

According to the image forming apparatus 1, time difference between times to end the lives of the heaters 53 and 54 having different heating widths with each other can be reduced. An effect will be described below. Before the description, an idea of the cumulative damage is introduced as an index to determine whether the life ends in the present embodiment. The cumulative damage is basically defined as cumulative lighting time×the number of times of lighting. However, since the cumulative damage is influenced by the size of the inrush current at the time of lighting the radiation heaters 53 and 54, it is necessary to consider the influence. Specifically, the size of the inrush current in a case where the preheating is controlled as in the present embodiment is different from that in a case where the preheating is not controlled. Therefore, the cumulative damage is defined in detail as the following formula (2).

$$\text{cumulative damage}=\text{cumulative lighting time}\times(\text{the number of times of lighting with no preheating}\times\text{inrush current coefficient}+\text{the number of times of lighting with preheating}) \quad (2)$$

Here, an inrush current coefficient is simply a value indicating an influence of the inrush current when the preheating is not performed. Therefore, there are various methods to define the inrush current coefficient. The inrush current coefficient is a value obtained by operating an actual machine of the image forming apparatus 1. For example, each of the radiation heaters 53 and 54 has a specific value (1.1 to 1.5). Further, for example, the inrush current coefficient can be a ratio between an inrush current value with no preheating (maximum amplitude value) and an inrush current value with preheating (maximum amplitude value) under a condition where the application voltages are the same.

Figure 6:
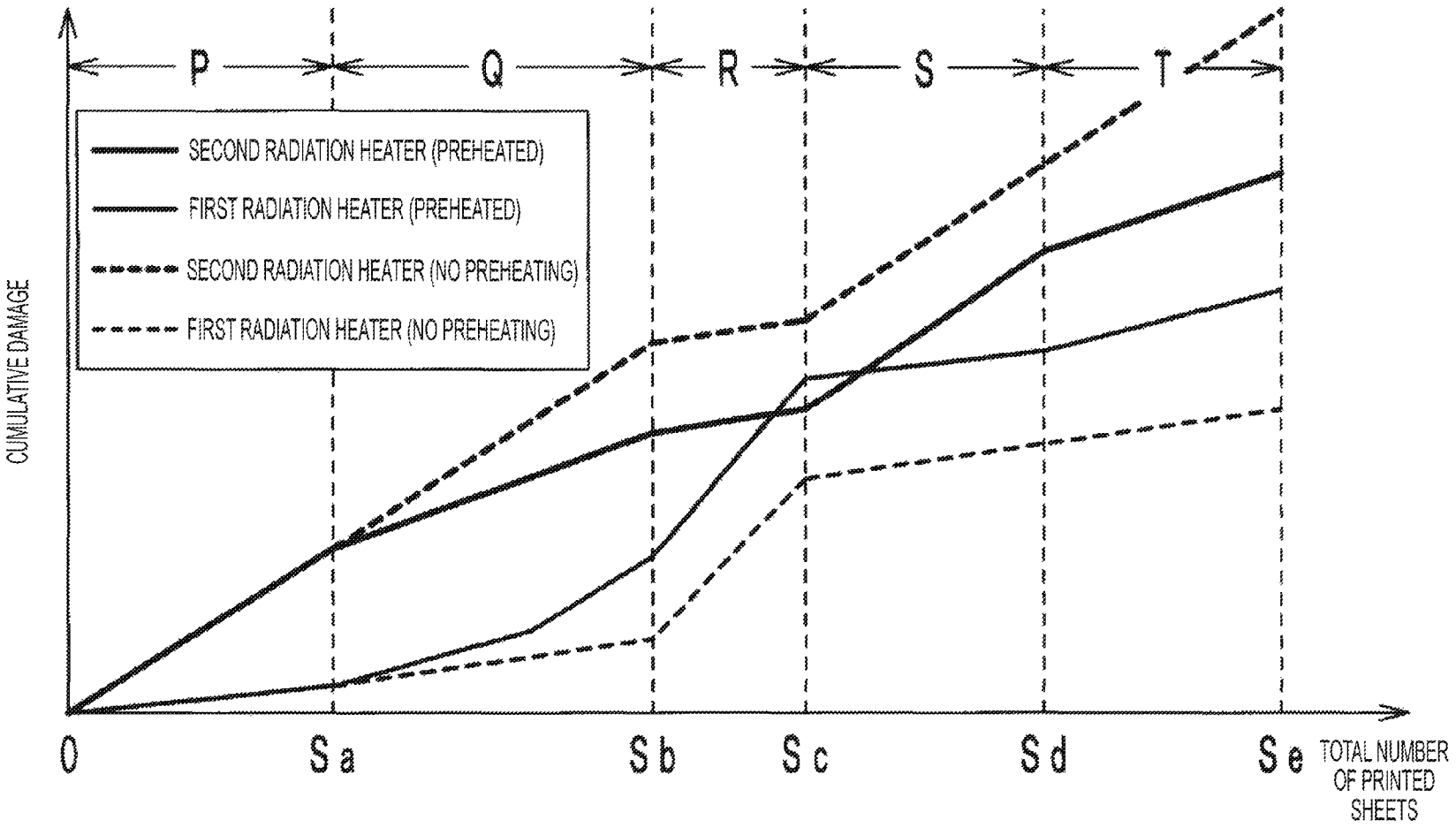
FIG. 6 is a graph of a change of a cumulative damage relative to the total number of printed sheets of the image forming apparatus in FIG. 1.

FIG. 6 is a graph of an exemplary change of the cumulative damage relative to the total number of printed sheets of the image forming apparatus 1. As illustrated in FIG. 6, in a section P where the total number of printed sheets is of zero to Sa, even when the controller 6 performs the processing in FIG. 3, the value ΔN is not determined to be equal to or more than n in S13. Therefore, the flag F is constantly set to be zero in S14. Accordingly, since the second radiation heater 54 is not preheated at the time of warm-up and standby, the damage to the second radiation heater 54 is accumulated at a speed faster than that of the first radiation heater 53 (refer to thin solid line and thick solid line).

Whereas, when the total number of printed sheets reaches Sa and it is determined that the value ΔN is equal to or more than n in S13 in FIG. 3, the second radiation heater 54 is preheated at least once at every A times of lighting. Therefore, according to the formula (2), the damage to the second radiation heater 54 is accumulated at a speed slower than that in the section P. By controlling the preheating, since the number of times of lighting increases, the damage to the first radiation heater 53 is easily accumulated (refer to section Q where the total number of printed sheets is equal to or more than Sa and less than Sb).

After the section Q, it is assumed that the image forming apparatus 1 perform printing to a large number of printing medium M which are smaller than a predetermined size. In this state, it is often determined as Yes in S22 in FIG. 5A, and a frequency for using the first radiation heater 53 increases. As a result, the damage to the first radiation heater 53 is easily accumulated (refer to section R where the total number of printed sheets is equal to or more than Sb and less then Sc).

After the section R, in the image forming apparatus 1, the number of times of determinations such that the value ΔN is equal to or more than n in S13 in FIG. 3 is reduced. Therefore, similar to a case of the section P, the damage is easily accumulated in the second radiation heater 54 (refer to section S where the total number of printed sheets is equal to or more than Sc and less than Sd). After the section S, the second radiation heater 54 is preheated at least once at every A times of lighting similarly to the section Q. Therefore, since the lighting frequency increases, the damage to the first radiation heater 53 is more easily accumulated than that in the section S (refer to section T where the total number of printed sheets is equal to or more than Sd and less than Se).

Relative to the above, regarding the image forming apparatus having no preheating control as the present embodiment, in the sections P and Q and the sections S and T, the damages are accumulated to both the radiation heater with a wide heating width and the radiation heater with a narrow radiation width according to the respective numbers of times of lighting (refer to thin broken line and thick broken line).

As described above, according to the present embodiment, time difference between times to the ends the lives of the radiation heaters 53 and 54 having different heating widths from each other can be reduced. Therefore, both the heaters 53 and 54 can be sufficiently used to the ends of their lives before the fixing unit 5 is exchanged.

Next, other effects will be described. First, an inrush current to the second drive unit 82 on the power supply line L2 can be reduced by preheating the second radiation heater 54. As a result, since the increase in the temperature of the second drive unit 82 due to the inrush current can be prevented, an effect to prolong the life of the second drive unit 82 can be expected.

Further, when the operation mode is to print, the second radiation heater 54 is not preheated. Accordingly, the heating roller 51 can be appropriately feedback controlled to be the target temperature.

Eighth Column: Supplementary Notes

In the fifth column, the description has been made in which the coefficient α is set to be a value which becomes smaller as the cumulative lighting time Tl gets longer. However, the coefficient α is not limited to this and may be set to be a value which becomes smaller as the lighting period of the second radiation heater 54 gets shorter. Accordingly, for example, in a case where a frequency in which the inrush current flows to the second radiation heater 54 increases, such as a case where a difference between the upper limit value and the lower limit value of the target temperature of the heating roller 51 is small, the execution frequency of the preheating to the second radiation heater 54 can be increased.

An image forming apparatus according to the present invention can reduce time difference between times to the ends the lives of first and second radiation heaters which have different heating widths from each other, and the image forming apparatus is suitable for a printer and the like.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image forming apparatus comprising:

a fixing unit configured to include at least a first and second radiation heaters capable of heating printing medium;

a power supply unit configured to supply power to the first and second radiation heaters; and a controller configured to select either one of the first and second radiation heaters and control to light or turn off the selected radiation heater so that a temperature of the fixing unit becomes a target value, wherein a heating width of the printing medium of the second radiation heater is wider than that of the first radiation heater, and the controller determines whether to preheat the second radiation heater based on the number of times of lighting of the first and second radiation heaters before a predetermined operation mode and controls to light and turn off the second radiation heater after lighting the first radiation heater when the controller has determined that it is necessary to preheat the second radiation heater.

2. The image forming apparatus according to claim 1, wherein the controller determines that it is necessary to preheat the second radiation heater when a difference between the number of times of lighting of the first radiation heater and that of the second radiation heater is equal to or less than a predetermined threshold.

3. The image forming apparatus according to claim 1, wherein the predetermined operation mode is either one of warm up or standby of the image forming apparatus.

4. The image forming apparatus according to claim 2, wherein the threshold is set to be a smaller value as cumulative lighting time of the second radiation heater gets longer.

5. The image forming apparatus according to claim 1, wherein the controller lights the first radiation heater to preheat the second radiation heater at every predetermined execution frequencies.

6. The image forming apparatus according to claim 5, wherein when it is assumed that a be a predetermined coefficient and Ns and Nl be the numbers of times of lighting of the first and second radiation heaters, the execution frequency is obtained from $\alpha/(Nl-Ns)$.

7. The image forming apparatus according to claim 6, wherein the coefficient is set to be a smaller value as cumulative lighting time of the second radiation heater gets longer.

8. The image forming apparatus according to claim 6, wherein the coefficient is set to be a smaller value as the lighting as a lighting period of the second radiation heater gets shorter.

9. The image forming apparatus according to claim 1, wherein the predetermined operation mode does not include time to print.

* * * * *